US011987407B2

(12) United States Patent
Stone et al.

(10) Patent No.: US 11,987,407 B2
(45) Date of Patent: May 21, 2024

(54) ROBOTIC STRAPPING MACHINE AND METHOD

(71) Applicant: Taylor-Winfield Technologies, Inc., Youngstown, OH (US)

(72) Inventors: Lee A. Stone, Girard, OH (US); Brian Rea, Boardman, OH (US); Jeffery Bell, Newton Falls, OH (US)

(73) Assignee: Taylor-Winfield Technologies, Inc., Youngstown, OH (US)

( * ) Notice: Subject to any disclaimer, the term of this patent is extended or adjusted under 35 U.S.C. 154(b) by 295 days.

(21) Appl. No.: 17/468,807

(22) Filed: Sep. 8, 2021

(65) Prior Publication Data

US 2022/0089305 A1 Mar. 24, 2022

Related U.S. Application Data

(63) Continuation of application No. 16/306,923, filed as application No. PCT/US2017/035895 on Jun. 5, 2017, now Pat. No. 11,142,359.

(60) Provisional application No. 62/358,368, filed on Jul. 5, 2016.

(51) Int. Cl.

| | |
|---|---|
| ***B65B 13/04*** | (2006.01) |
| ***B65B 25/14*** | (2006.01) |
| ***B65B 27/06*** | (2006.01) |

(52) U.S. Cl.

CPC ..... *B65B 13/04* (2013.01); *B65B 25/148* (2013.01); *B65B 27/06* (2013.01)

(58) Field of Classification Search

CPC ..... B65B 13/04; B65B 13/06; B65B 13/14; B65B 13/18; B65B 27/06; B65B 25/148

USPC ..... 100/12, 26

See application file for complete search history.

(56) References Cited

U.S. PATENT DOCUMENTS

| | | | | |
|---|---|---|---|---|
| 4,829,753 | A | 5/1989 | Bricmont | |
| 4,951,562 | A | 8/1990 | Ribaldo | |
| 5,282,347 | A * | 2/1994 | Cleine | B65B 25/24 53/204 |
| 5,400,706 | A | 3/1995 | Tipton et al. | |
| 5,540,142 | A | 7/1996 | Mieleszuk et al. | |
| 6,305,145 | B2 | 10/2001 | Suolahti | |

(Continued)

FOREIGN PATENT DOCUMENTS

| | | |
|---|---|---|
| FR | 2057524 A5 | 5/1971 |
| WO | WO 2015/119499 | 8/2015 |

OTHER PUBLICATIONS

International Search Report and Written Opinion, dated Aug. 31, 2017, issued in connection with PCT/US2017/035895, filed Jun. 5, 2017.

*Primary Examiner* — Jimmy T Nguyen

(74) *Attorney, Agent, or Firm* — Lippes Mathias LLP

(57) ABSTRACT

A strapping system and method for automatically applying strapping to at least one associated object, such as a roll of coiled material having a void. The system includes a first end effector and second end effector, each end effector mountable to a robotic arm and including at least a portion of a chute, the end effectors movable relative to each other when mounted to a robotic arm such that the chute portions of each end effector can be selectively brought together in a plurality of orientations to define a generally continuous chute loop through which a strapping material can be advanced to surround the at least one associated object located at least partially within the chute loop.

10 Claims, 10 Drawing Sheets

(56) References Cited

U.S. PATENT DOCUMENTS

| | | | | |
|---|---|---|---|---|
| 6,594,976 | B1 | 7/2003 | Chikamitsu | |
| 7,526,995 | B2 | 5/2009 | Actis | |
| 7,861,649 | B2 | 1/2011 | Bobren | |
| 7,963,087 | B2 * | 6/2011 | Lansikallio | B65B 25/24 53/399 |
| 8,037,661 | B2 | 10/2011 | Albert | |
| 8,051,770 | B2 | 11/2011 | Song | |
| 2009/0158692 | A1 | 6/2009 | Lansikallio | |
| 2009/0308267 | A1 | 12/2009 | Song | |
| 2011/0214578 | A1 | 9/2011 | Liu | |

* cited by examiner

ROBOTIC STRAPPING MACHINE AND METHOD

CROSS REFERENCE TO RELATED PATENTS AND APPLICATIONS

This continuation application claims priority to and the benefit of the filing date of U.S. patent application Ser. No. 16/306,923, filed Dec. 4, 2018, which application claims priority to and the benefit of the filing date of International Application No. PCT/US2017/035895, filed Jun. 5, 2017, which application claims priority to and the benefit of the filing date of U.S. Provisional Patent Application Ser. No. 62/358,368, filed Jul. 5, 2016, which application is hereby incorporated by reference.

BACKGROUND

The present exemplary embodiment relates to strapping machines. It finds particular application in conjunction with automated strapping machines, and will be described with particular reference thereto. However, it is to be appreciated that the present exemplary embodiment is also amenable to other like applications.

Plastic or metal strapping (also sometimes referred to as banding) is commonly used to bind together shipping pallets and/or the goods supported thereon. Strapping is also used in other applications where items are to be bound together. For example, strapping is often used to secure a roll of paper of other material to prevent unraveling during shipping, transport and/or storage.

In a machine for strapping a shipping pallet, together with goods supported by the shipping pallet, one or more steel or plastic straps are passed around and/or through the shipping pallet and/or the goods, tensioned, and overlapping portions of each strap are secured together, such as by welding or crimping or other suitable methods. In a typical application, a number of such straps are secured about the shipping pallet and/or goods in orthogonal planes. While manual application of strapping is possible, automated systems generally will also include a feeding conveyor or other transport positioning the shipping pallet with goods supported thereon for automatic application of the strapping.

In such automatic systems, typically one or more strap guides may be of a fixed configuration. Such machines may often have one or both of a vertical or horizontal strap guide in the form of an elongate channel. The strap guides generally form a loop or perimeter around which the strapping is configured to travel such that any object (e.g., a shipping pallet, etc.) placed within the loop is in position to be surrounded by the strapping. Basic fixed strapping machines have been in use for many years, and provide adequate strapping functionality in settings where strapping orientation is static.

It has also been known to strap coiled material (e.g., sheet metal coil, paper coil, etc.) by securing strapping around an outside diameter of the coil or by feeding a steel or plastic strap through the central opening or bore of the coiled material, tensioning the strap to form a tensioned loop around multiple layers of the coiled material, and securing the strapping. Exemplary machines for applying strapping to coils in the latter configuration generally include a pair of adjustable strap-guiding arms and an adjustable strapping head for tensioning and securing the strapping. The strap-guiding arms are selectively positionable within the central opening of the coiled material, and the strapping head is operative for feeding the strap along the path defined by the strap-guiding arms when positioned within the central opening of the coiled material. The strapping head is further configured to tension the strap, sever the tensioned loop, and secure the loop in applying a steel seal to the tensioned loop. These devices are limited in use to strapping a single roll of material.

Automated strapping of multiple coils of material has heretofore been performed manually by manually passing strapping through the central bores of two coils of material, tensioning the strapping, and securing the same. Manual strapping is time consuming and can be difficult to perform when strapping large coils.

BRIEF DESCRIPTION

In accordance with one aspect of the present disclosure, a strapping system for automatically applying strapping to at least one associated object comprises a first end effector and second end effector, each end effector mountable to a multi-axis positioner, such as a robotic arm, and including at least a portion of a chute, the end effectors movable relative to each other when mounted to a robotic arm such that the chute portions of each end effector can be selectively brought together in a plurality of orientations to define a generally continuous chute loop through which a strapping material can be advanced to surround the at least one associated object located at least partially within the chute loop.

At least one of the portions of the chute can be adjustable to change a dimension of the chute. At least one of the end effectors can further include a strapping head configured for retaining, severing and joining together adjacent portions of a strapping material after it is advanced through the chute. At least one of the end effectors can further include a strap feeding/tensioning device, the strap feeding/tensioning device configured to advance strapping material through the chute, and to apply tension to the strapping material after advancing the strapping material through the chute so as to draw the strapping material against the at least one associated object prior to the strapping head joining together and severing the strapping material. At least one of the chute portions can be c-shape, whereby when the chute portions are brought together the chute is a rectangular chute. The at least one c-shape chute portion can be comprised of a vertical chute portion, a stationary chute portion fixed to the vertical chute portion and extending at a right angle thereto, and a movable chute portion movably connected to the vertical chute portion and extending at a right angle thereto. A sensor can be mounted to at least one of the chute portions for detecting a void in a coil of material. A sensor can also be provided for detecting when the chute portions are abuttingly engaged. The chute portions can include pivotable chute brackets adapted to move between a closed position for retaining a strapping material during feeding of the strapping material through the chute, and an open position for releasing the strapping material when tension is applied to the strapping material. The chute portions of each end effector can include a protrusion/recess for mating with a corresponding recess/protrusion on the other when the chute portions are brought together, whereby the protrusions/recesses align the chute portions. The system can further include robotic arms to which the end effectors are mountable, whereby the end effectors are movable in the X-Y-Z dimensions.

In accordance with another aspect, a method of automatically installing strapping material to an associated object having a void is set forth. The method comprises positioning a first chute portion within the void, joining the first chute portion to a second chute portion to form a continuous chute, advancing a strapping material through the continuous chute to form a loop of strap material, and joining a free end of the strapping material to the standing portion of the strapping material to thereby form a secured loop of strapping material passing through the void.

At least one of the first chute portion or second chute portion can be part of an end effector mounted to a robotic arm. The method can further include sensing the void of the associated object using a sensor mounted on at least one of the first or second chute portions, and/or using a sensor to detect when the first and second chute portions are joined together to thereby form the continuous chute. The first chute portion can be part of a first end effector mounted to a first robotic arm and the second chute portion can be part of a second end effector mounted to a second robotic arm. The positioning the first chute portion can include locating the void using a sensor mounted to the first end effector and advancing the chute portion at least partially into the void. The joining the first chute portion with the second chute portion can include advancing the second chute portion at least partially into the void from an opposite side than the first chute portion such that the first and second chute portions are joined together within the void of the associated object. The first and second chute portions can be simultaneously brought into abutting engagement within the void. The first robotic arm and second robotic arm can be controlled in a master/slave arrangement with the second robotic arm mirroring movement of the first robotic arm. The method can also include tensioning the strapping material prior to joining the free end of the strapping material to the standing portion of the strapping material.

DETAILED DESCRIPTION

Figure 1:
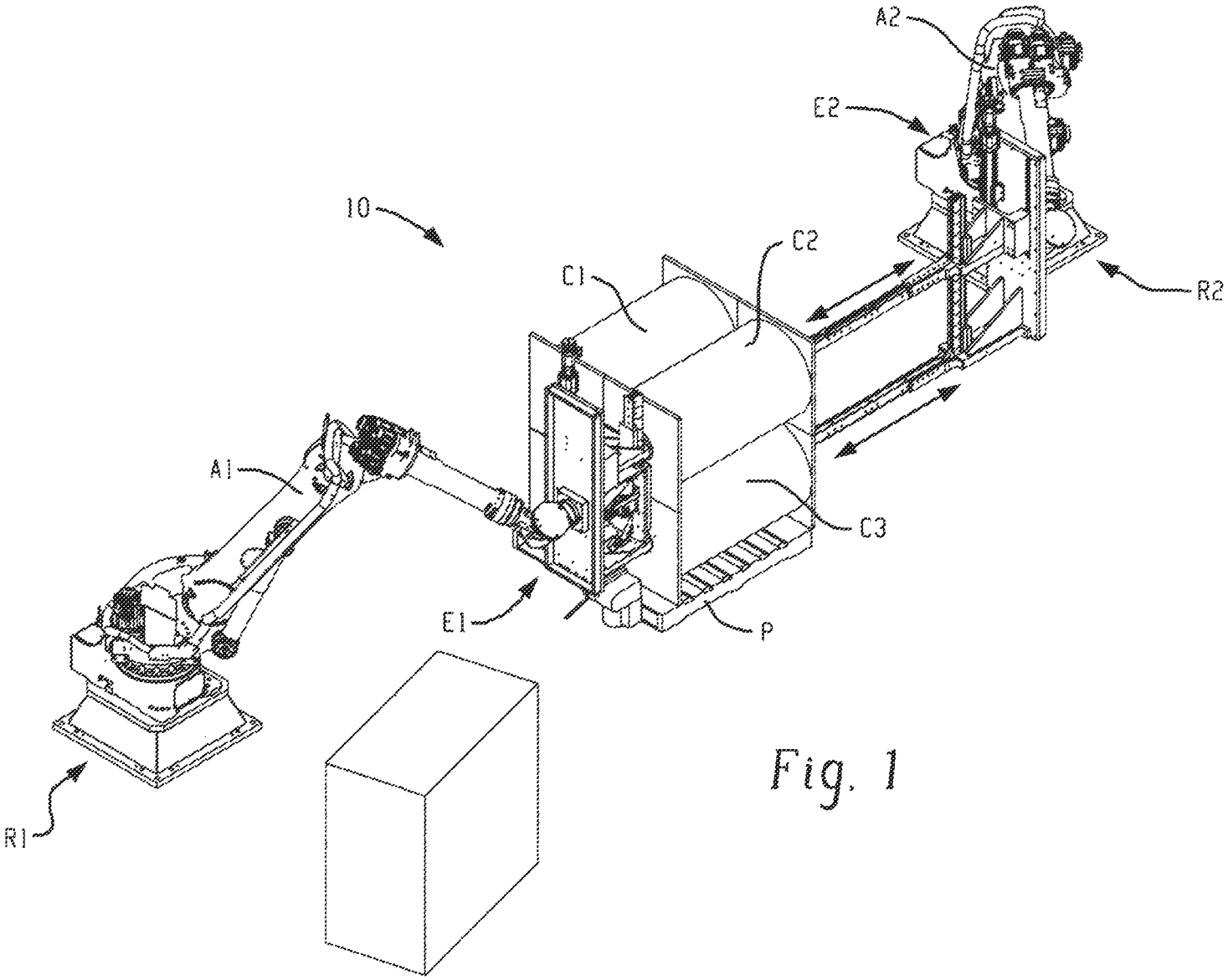
FIG. 1 is a perspective view of an exemplary system in accordance with the present disclosure.
Figure 2:
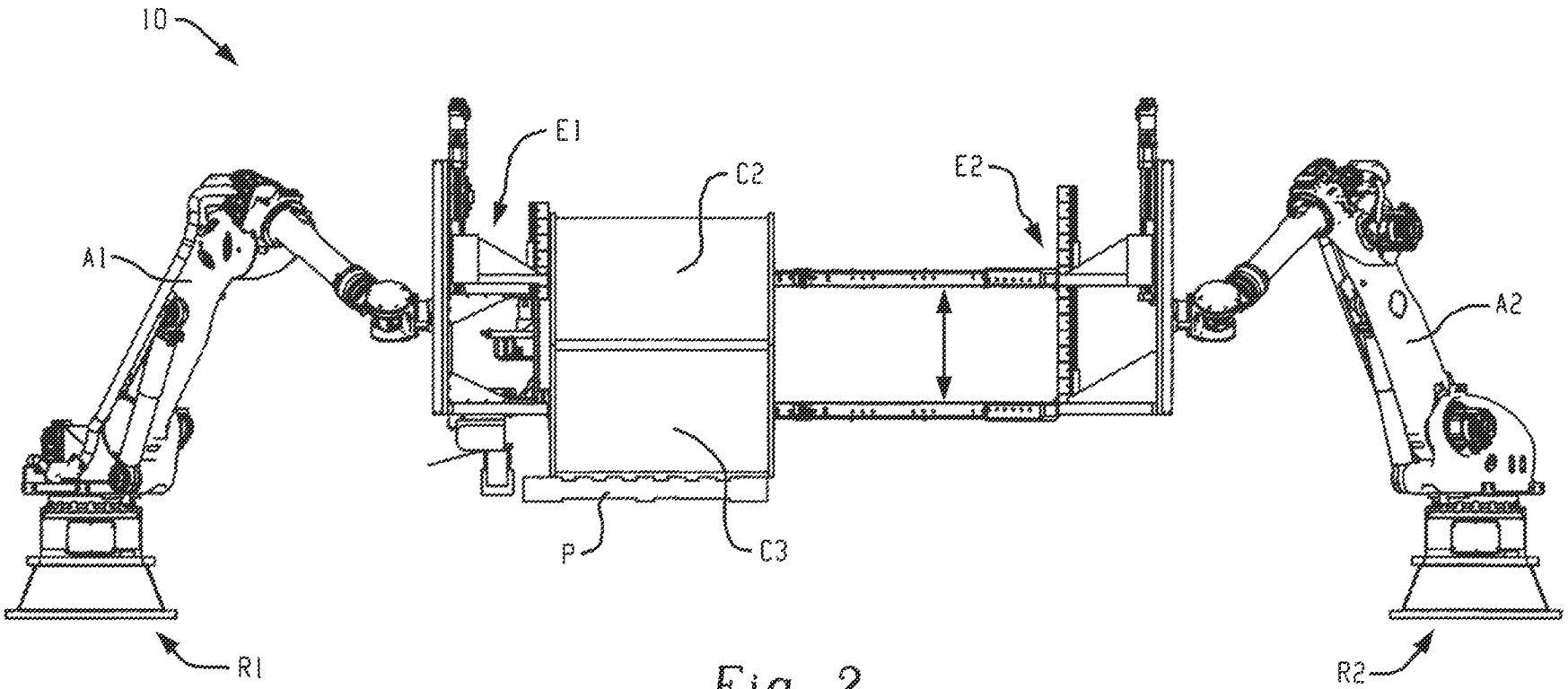
FIG. 2 is a side elevation view of the exemplary system.
Figure 3:
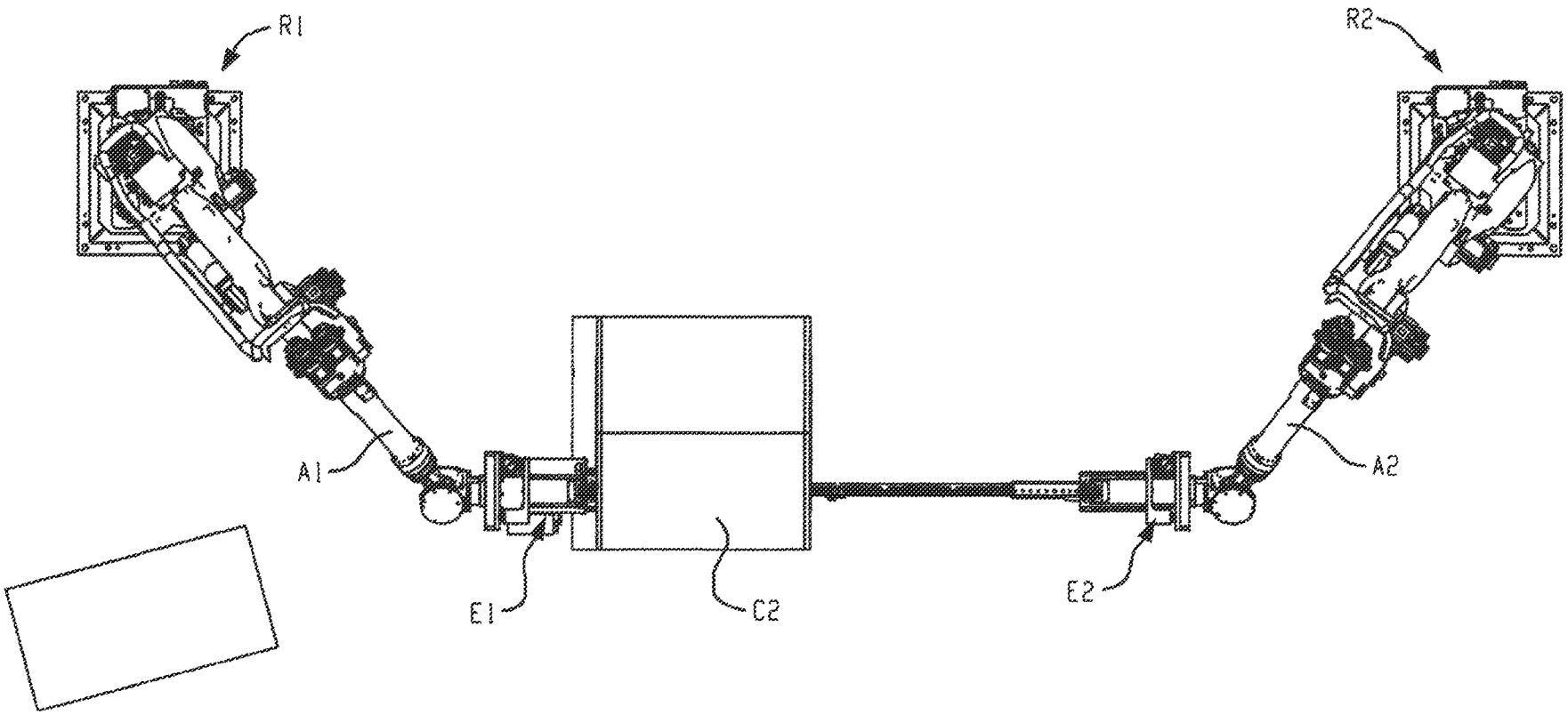
FIG. 3 is a plan view of the exemplary system.

With reference to FIG. 1, an exemplary system 10 is illustrated including a first robot R1 and a second robot R2. Each robot R1 and R2 includes an articulated robotic arm A1 and A2, respectively. Each robotic arm A1 and A2 has mounted thereon a respective end effector E1 and E2. Each end effector E1 and E2 is supported by its associated robotic arm A1 or A2 for movement in the X-Y-Z dimensions, as well as rotation relative to the robotic arm to which it is attached. This configuration allows virtually limitless positioning and/or orientation of the end effectors E1 and E2 with respect to the object or objects to be strapped.

Figure 4:
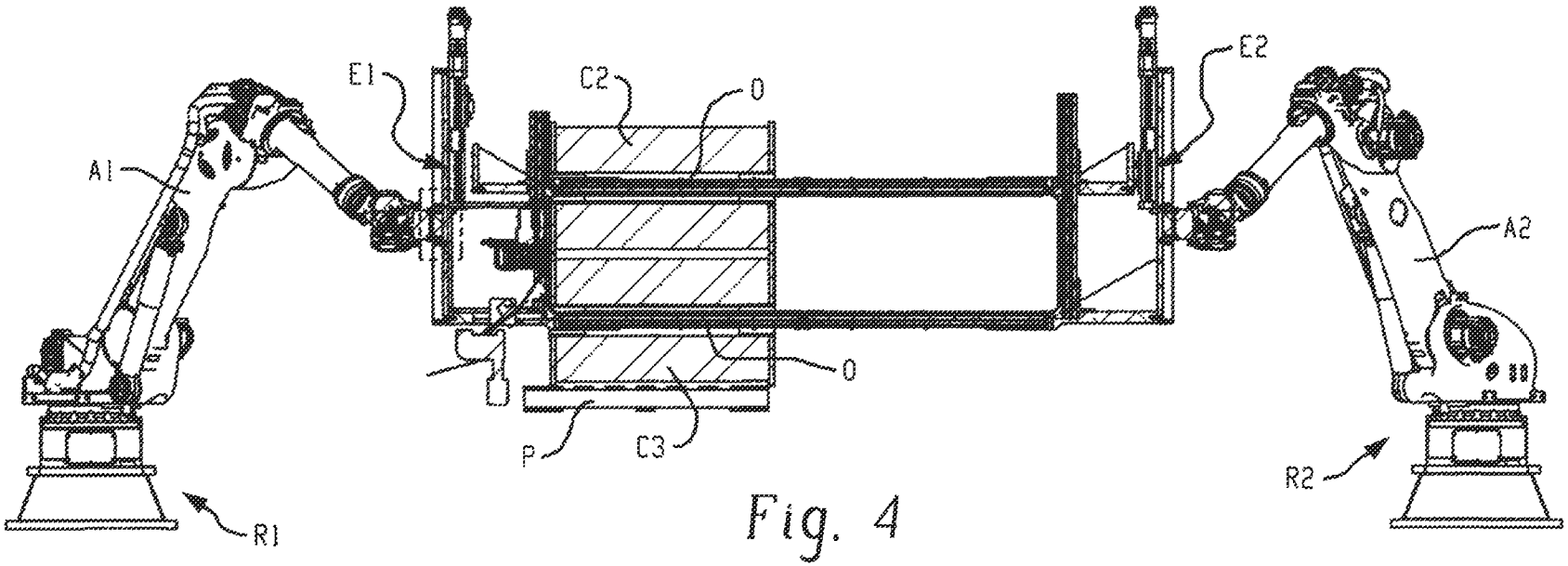
FIG. 4 is a partial cross-sectional view of the exemplary system.

In the illustrated embodiment, the objects to be strapped include four rolls of coiled material C1, C2, C3 and C4 (C4 not visible in FIG. 1), such as rolls of plastic or paper sheet material. The rolls C1-C4 are initially supported in a 2×2 stacked configuration on a pallet P or other support. Each of the rolls includes a void in the form of a central bore or opening O (see FIG. 4) extending therethrough, through which strapping material is to be passed to secure adjacent rolls together. That is, the present disclosure provides an automated system for positioning strapping material to form a loop extending through each central bore O of two adjacent rolls of coiled material.

Figure 5:
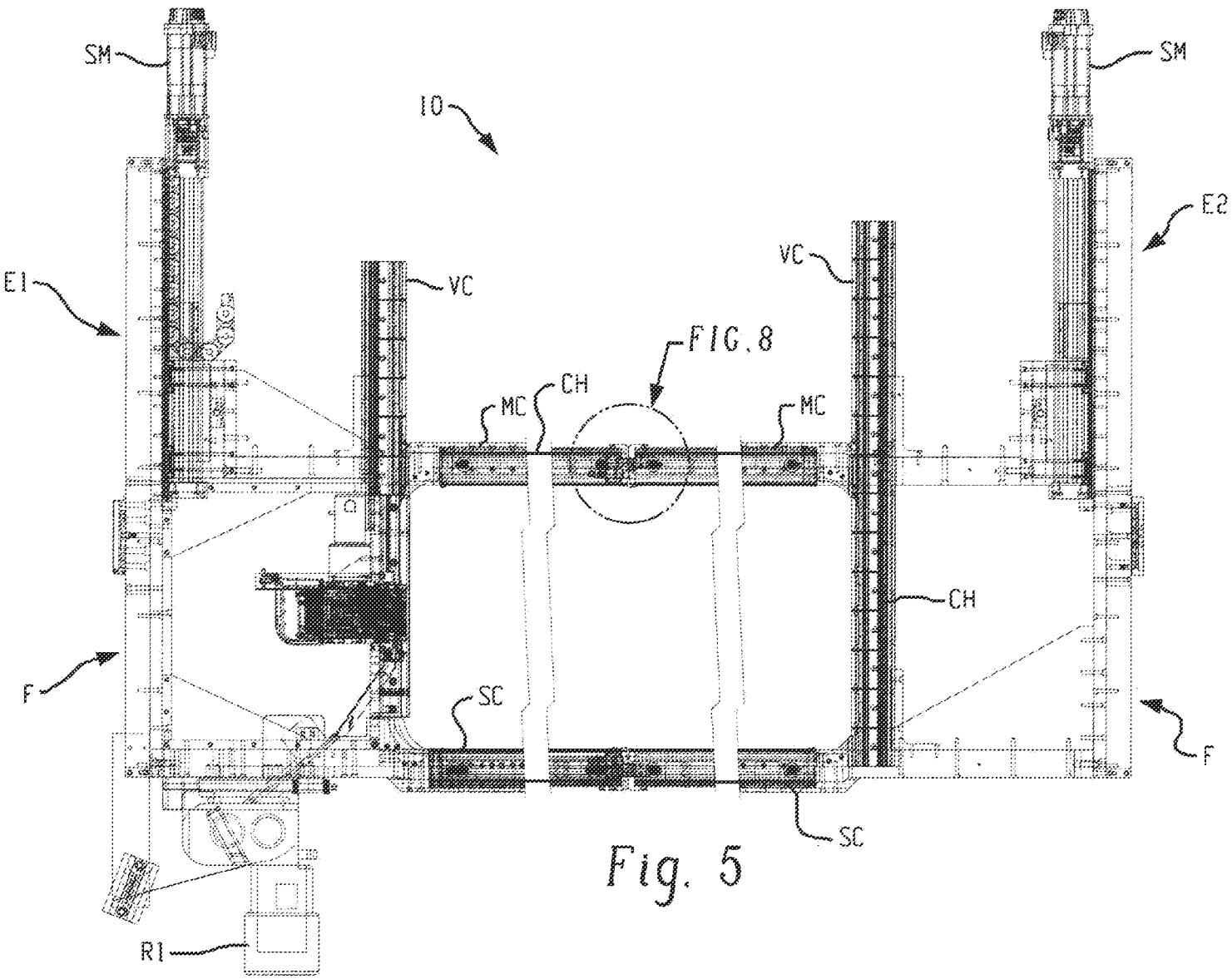
FIG. 5 is an enlarged cross-sectional view of the exemplary system illustrating additional details.

With further reference to FIG. 2-5, system 10 is illustrated in position for strapping together rolls C2 and C3. To this end, each end effector E1 and E2 is positioned relative to the rolls C2 and C3 such that corresponding portions of a strapping chute extend through the central bores of each roll. In the illustrated embodiment, end effector E2 includes a C-shape chute having distal end portions inserted into the central bores of the rolls C2 and C3 a sufficient distance to mate, engage with, or otherwise cooperate with a corresponding chute portion of end effector E1 such that a generally continuous chute CH (as shown in FIG. 5) is defined by the first and second end effectors, said chute CH extending through both central bores O of the rolls C2 and C3 and about a portion of each axial end face of each of the rolls C2 and C3.

It will be appreciated that positioning the chute portions of each end effector can be done using computer vision techniques and/or other positioning methods adapted to locate the central bore of each roll and move the end effectors into position. In one embodiment, one end effector is configured to locate the central bores via a laser, and the other end effector is configured to then come into mating position with the first end effector. A magnetic switch or other sensing device can be provided to confirm the chute portions of the first and second end effectors E1 and E2 are in mating position to define the generally continuous chute CH.

Once in position, strapping S is deployed via end effector E1. The strapping S is advanced through the central bores of rolls C2 and C3 via chute CH and around the axial end faces of the same until the strapping S is returned to end effector E1. A tensioning mechanism is then deployed to tension the strapping to thereby draw rolls C2 and C3 together. After tensioning, the strapping is secured, such as by heat or friction welding, and trimmed as needed. As used herein, it will be appreciated that the term free end is the terminal end of the strapping material that is initially advanced through the chute, while the standing portion of the strapping material is any portion of the strapping material that is not the free end.

It should be appreciated that securing rolls C1-C4 together generally includes strapping each roll individually to at least two other rolls. In this regard, strapping may typically be installed between rolls C1 and C2, C2 and C3, C3 and C4, and C4 and C1. Further strapping can be installed diagonally between rolls C1 and C3 and/or C2 and C4, for example.

With additional reference to FIGS. 5-7, further details of the exemplary system 10 will be described. FIG. 5 is a cross-sectional view taken through end effectors E1 and E2 illustrating the strapping chute CH formed as a generally continuous loop when end effectors E1 and E2 are positioned with their respective chute portions in abutting engagement. The structural members of each end effector E1/E2 forming the strapping chute CH are generally the same and will be described together. To this end, each end effector includes a stationary chute SC and a movable chute MC. A vertical chute VC connects the stationary chute SC and the movable chute MC thereby forming the general c-shape chute portion referred to above. Each of the stationary chute SC, movable chute MC and vertical chute VC are supported by a frame F of the end effector, which in turn is connected to a respective robot R1 or R2 (R2 not shown in FIG. 5). In this description, the stationary chute SC is fixed relative to the vertical chute VC and the movable chute MC is movable relative to the stationary chute SC along the vertical chute VC.

It will be appreciated that the movable chute MC is movable vertically in FIG. 5 to change the vertical spacing of the movable chute MC relative to the stationary chute SC so as to change a vertical dimension of the chute CH. It will further be appreciated that both the movable chute MC and the stationary chute SC can have telescoping portions thereof for extending/retracting so as to change a horizontal dimension of the chute CH. In other embodiments, the movable and stationary chutes MC and SC are of a fixed length such that the horizontal dimension of the chute CH is fixed.

Figure 6:
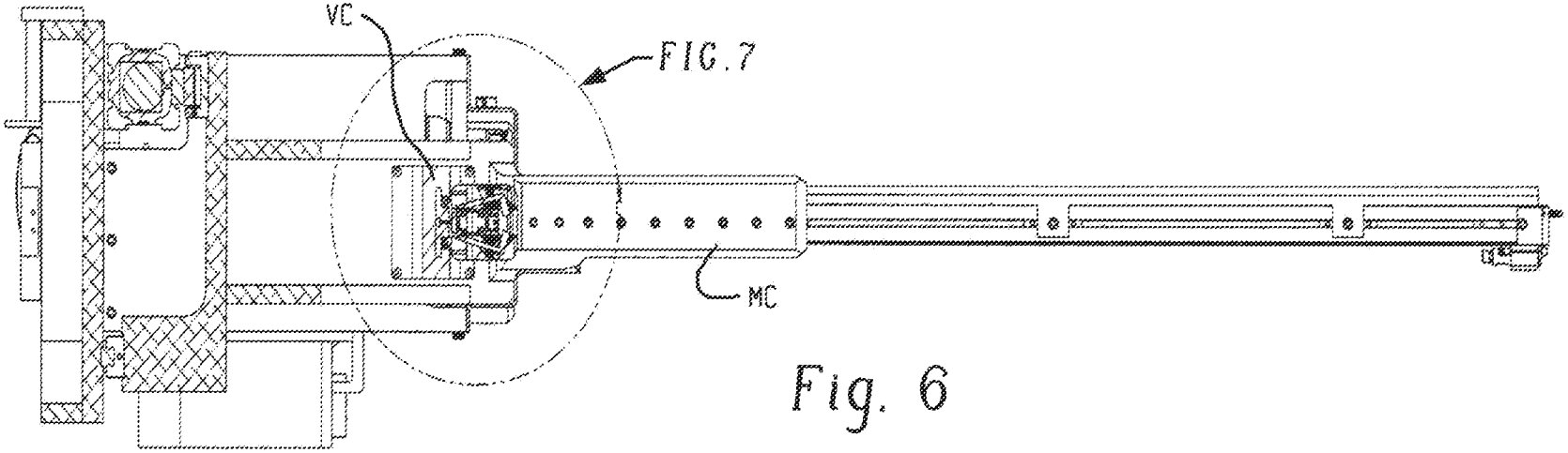
FIG. 6 is an enlarged cross-sectional view of a portion of FIG. 5.
Figure 7:
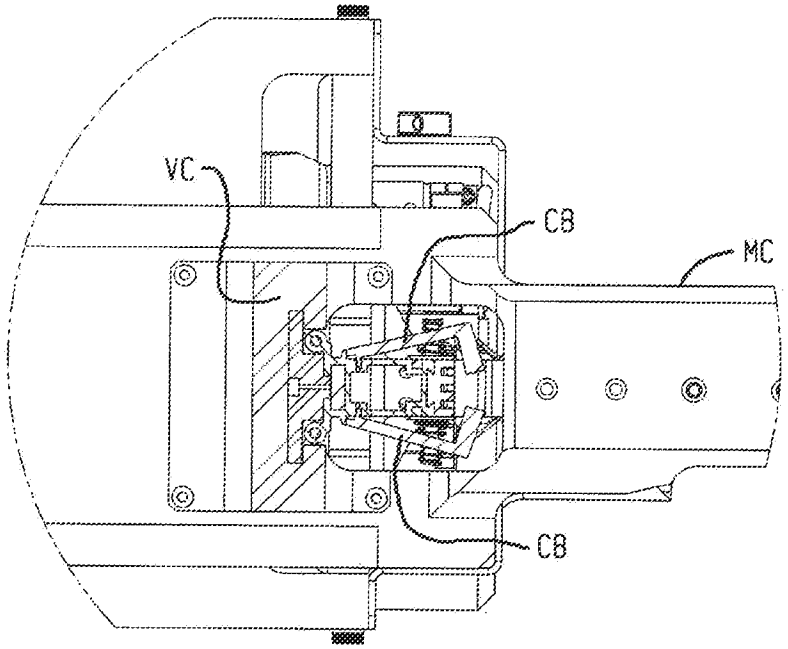
FIG. 7 is another cross-sectional view of the exemplary system illustrating the strapping chute.

With reference to FIGS. 6 and 7, it will be appreciated that the chute CH is formed from a plurality of opposed generally L-shape (in cross-section) chute brackets CB (See FIG. 7) approximately four to eight inches long that are aligned end-to-end and supported along the vertical chute VC, movable MC and stationary chute SC portions of each end effector. Each bracket is pivotally secured and biased towards a closed position for forming the chute CH therebetween. As will be appreciated, once a strap is advanced through the chute C, the chute brackets CB can pivot away from each other to an open position to release the strap as tension is drawn on the strap. After releasing the strap, the chute brackets CB return to the closed position.

Each movable chute MC is coupled to a servo motor SM for precise adjustment of the movable chute MC in the vertical direction, as will be described in more detail below. Vertical adjustment of the movable chute MC is useful for accommodating coils of material of different diameters by adjusting the vertical dimension of the chute CH.

In the embodiment illustrated in FIG. 5, end effector E1 and end effector E2 operate in a master/slave arrangement. In this arrangement, end effector E1 is configured to locate one or more hollow central bores or openings O in one or more coils of material, and advance the stationary chute SC and movable chute MC into the opening(s) in the coiled material until fully engaged such that a strapping head SH supported on the vertical chute VC is adjacent the coil of material. Meanwhile, end effector E2 is configured to mirror the movement of end effector E1 so as to align and extend its movable chute MC and stationary chute SC into the opening(s) of the coiled material from the opposite side, and mate/abut with the stationary chute SC and movable chute MC of end effector E1. In some embodiments, the movement of the end effectors E1/E2 occurs simultaneously, with end effector E2 essentially mirroring movement of end effector E1 as the movable and stationary chutes of each end effector are aligned and inserted in the central bore of the coiled material. In other embodiments, end effector E1 may be manipulated first, with end effector E2 being manipulated after end effector E1 has first been aligned and inserted in the coiled material.

To aid in alignment and insertion of the movable chutes MC and/or stationary chutes SC into the central bore of the coiled material, the movable chutes MC and/or stationary chutes each include a transition block TB at a terminal end thereof that includes one or more of 1) hardware for detecting both the location of the central bore, 2) hardware for detecting when the chutes of end effector E1 are engaged/abutted with the chutes of end effector E2, and or 3) an alignment pin or other structure for ensuring accurate alignment of the components when in abutting engagement.

Figure 8:
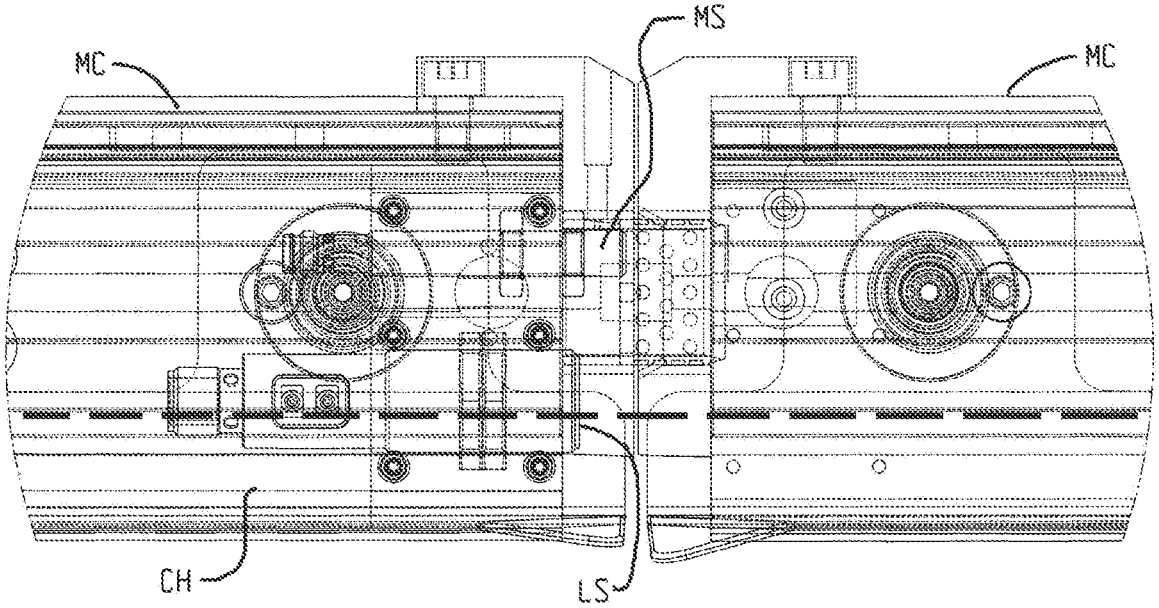
FIG. 8 is a side view of mated alignment members of the exemplary system.

These features are best seen in FIGS. 8-13. As seen in FIG. 8, which is an enlarged portion of FIG. 5 illustrating the transition blocks TB of the movable chutes MC of each end effector in abutting engagement, a laser switch LS is provided for locating voids (e.g., the central bore O of the coiled material). Other sensors can be used in place of or in addition to the laser switch for sensing the central bore. Such sensors can include for example, ultrasonic sensors, cameras, electronic eyes, etc. Chute CH is shown as a dashed line in FIG. 8 because it is generally concealed in this view.

In addition, a magnetic switch MS is configured to detect when the movable chutes MC of each end effector E1 and E2 are in abutting engagement. It will be appreciated that other devices for sensing engagement between the movable chutes can be provided (e.g., mechanical switches, etc.). In some embodiments, the end effectors E1/E2 can be equipped to detect when the movable chutes are abuttingly engaged based on force vs. displacement analysis wherein an increase in force and/or a decrease in displacement of one or both of the end effectors generally indicates the movable chutes are abuttingly engaged.

Figure 9:
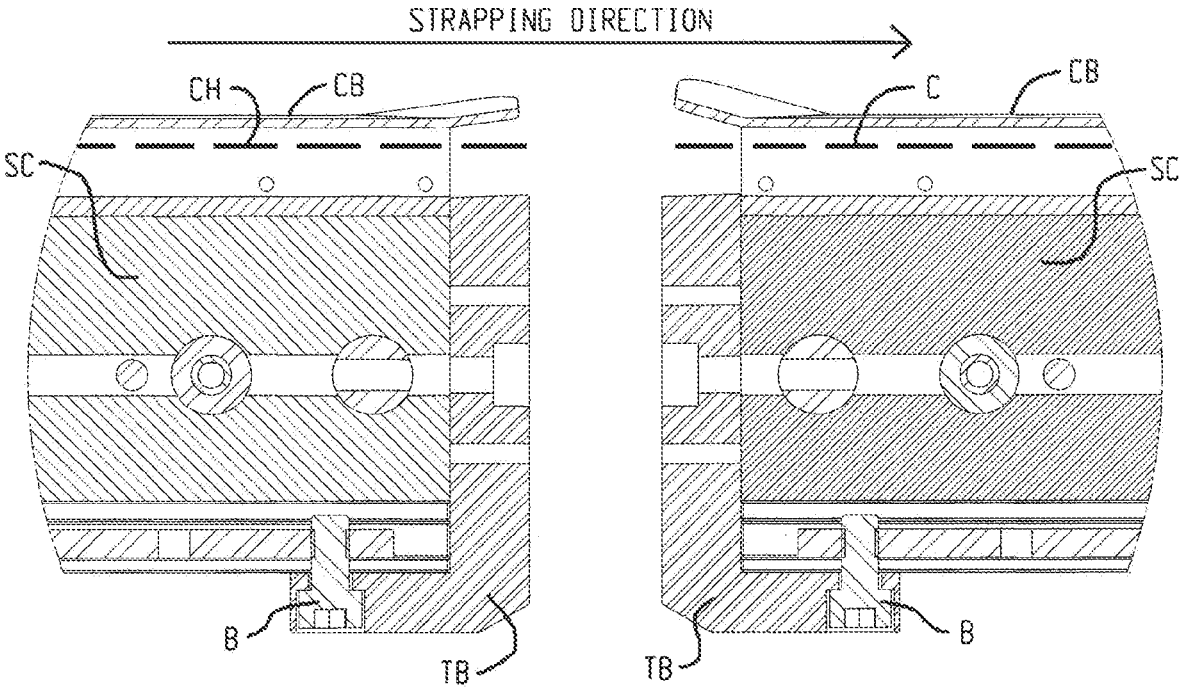
FIG. 9 is a cross-sectional view taken through the line 9-9.
Figure 10:
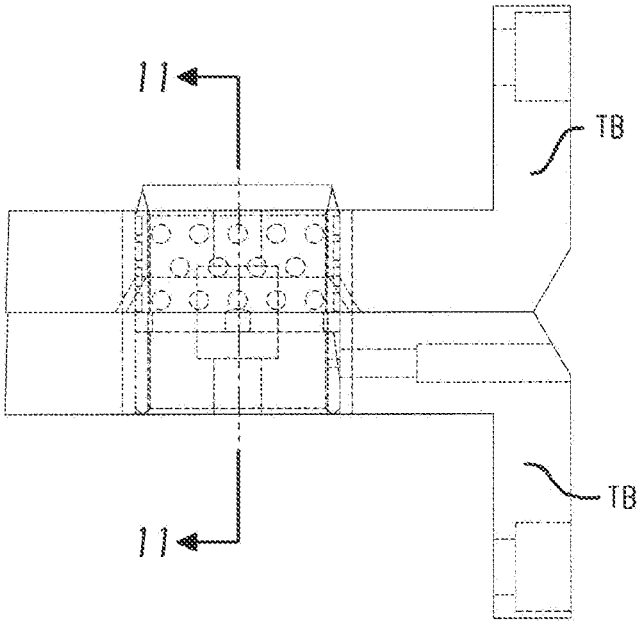
FIG. 10 is a front view of the mated alignment members of the exemplary system.
Figure 11:
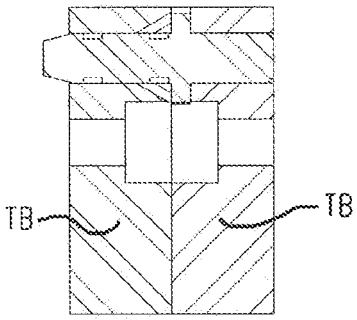
FIG. 11 is a cross-sectional view taken through the line 11-11 in FIG. 10.
Figure 12:
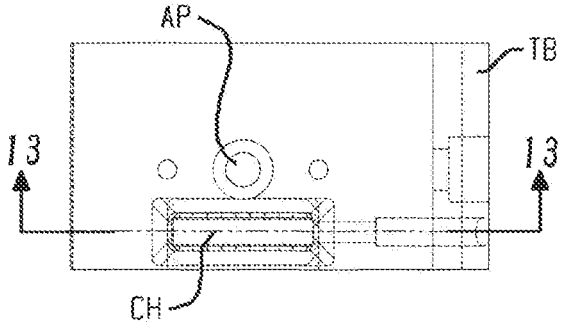
FIG. 12 is yet another side view of the mated alignment members of the exemplary system.
Figure 13:
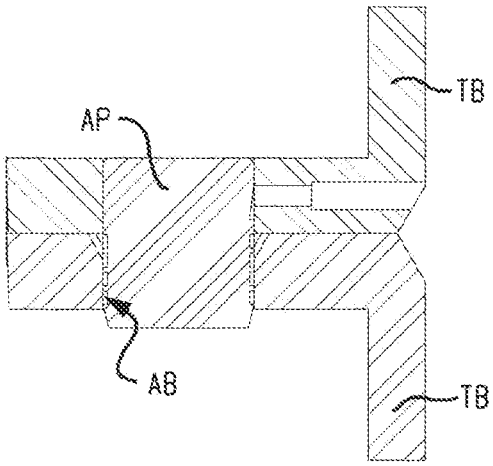
FIG. 13 is a cross-sectional view taken through the line 13-13 in FIG. 12.

With reference to FIG. 9, the transition blocks TB of the stationary chutes SC are shown. Like the transition blocks TB of the movable chutes MC, the transition blocks TB can be secured to the stationary chutes SC with fasteners, such as bolts B, or the like. Although not shown, it will be appreciated that the transition blocks TB of the stationary chutes SC can also include one or more sensors as described in connection with the transition block TB of the moveable chutes MC.

FIGS. 10-13 illustrate various views of an exemplary chute alignment pin AP for aligning respective transition blocks TB. Chute alignment pin AP is received in an alignment bore AB when the movable chute MC and stationary chute SC are fully engaged with respective movable chute MC and stationary chute SC of the other end effector. The alignment pin AP ensures precise alignment of the transition blocks TB to reduce or eliminate jamming of strapping during advancement of the strap through the chute C.

Figure 14:
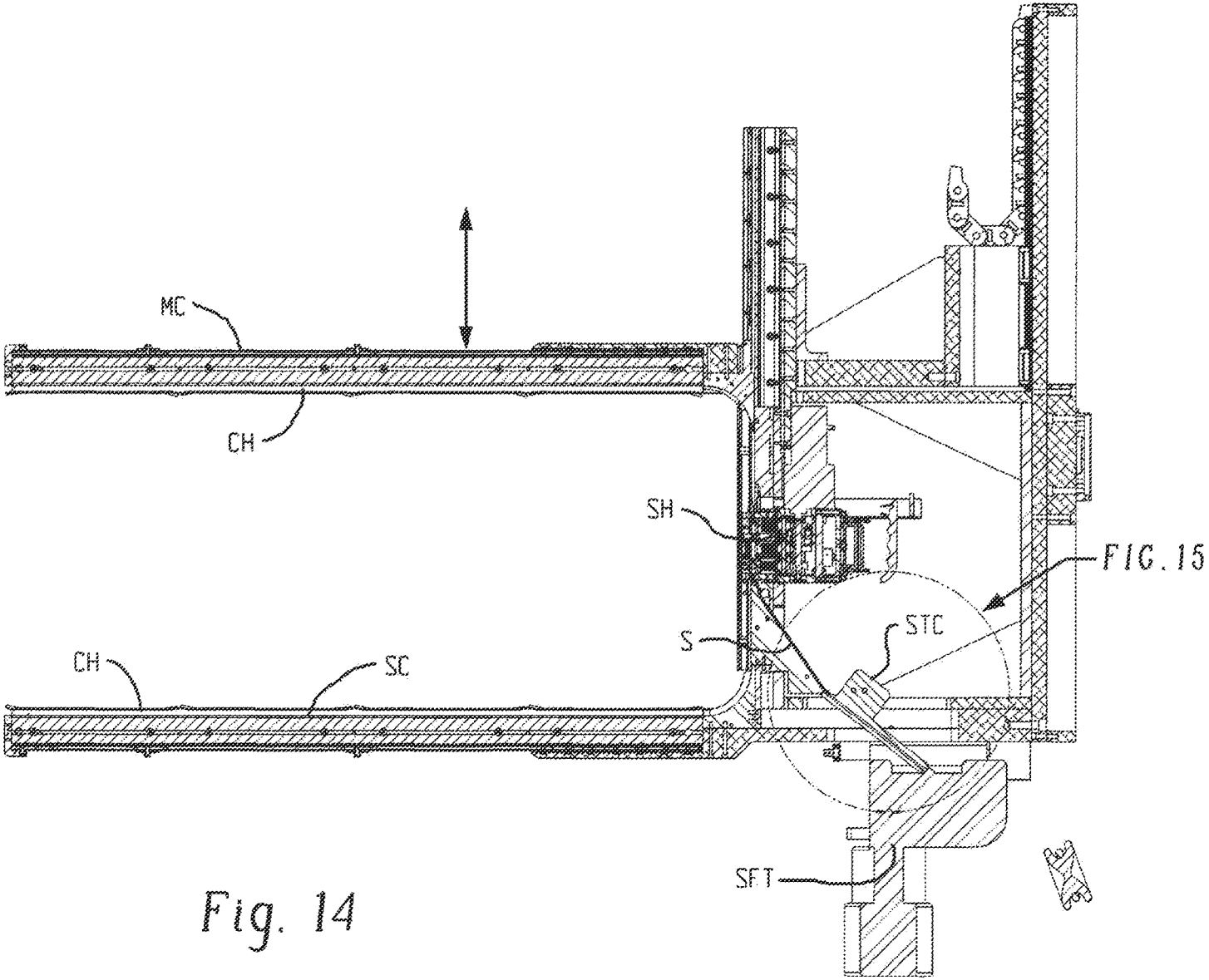
FIG. 14 is a partial cross-sectional side elevation view of the exemplary system.
Figure 15:
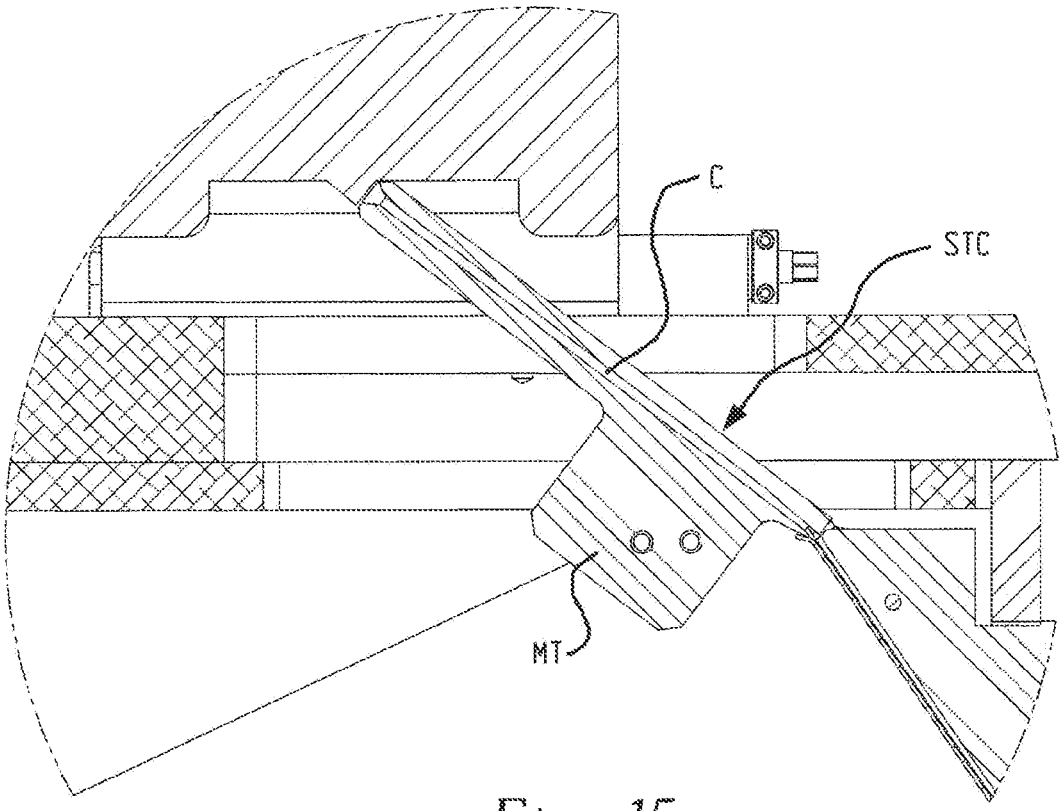
FIG. 15 is an enlarged portion of FIG. 14.

Turning now to FIGS. 14 and 15, a cross-section of end effector E1 and related components is shown. In these figures, the strapping head SH and strap feeder/tensioner SFT is visible. As noted above, the strapping head SH can be any suitable strapping head. The exemplary strapping head SH operates to sever and bond the strap material after it is fed through the chute CH and tensioned by strap feeder/tensioner SFT. As will also be appreciated, the strap feeder/tensioner SFT can be any suitable strap feeder/tensioner.

It should be appreciated, however, that the present exemplary system utilizes a strap transition component STC for guiding the strapping material S into the strapping head SH and chute CH. As best seen in FIG. 15, the strap transition component STC has a mounting tab MT for securing to the system, and a channel CH for guiding the strap material. The strap transition component STC is mounted such that the channel CH is oriented to provide a gradual transition of the approach angle of the strapping material S to the strapping head SH. The STC retains and controls the transition of the strap on all four sides as it approaches the main chute area.

As noted above, aspects of the present disclosure permit positioning of the end effectors E1/E2 in a wide variety of positions and orientations to enable the machine 10 to install such strapping in the configurations mentioned in the previous paragraph (as well as many other configurations) without the need to reposition the rolls C1-C4. In addition, the chute portions of one or both end effectors can be adjustable in length and/or lateral spacing to accommodate rolls of coiled material having various axial lengths and/or diameters.

In some embodiments, multiple chutes can be configured to allow simultaneously strapping of more than two rolls of material. For example, the chute components can be duplicated to provide a pair of chutes CH so that pairs of rolls C1/C2 and C3/C4 can be strapped together simultaneously. In such embodiment, the transverse spacing between the respective dual chutes can be adjustable to accommodate rolls of different sizes.

Suitable strapping heads for use with aspects of the present disclosure are available commercially. In addition, the strapping chute components (e.g., the portions of the movable chutes MC, stationary chutes SC and vertical chute VC) are also available commercially.

It should be appreciated that aspects of the present disclosure can be used for applying strapping to objects other than coils/rolls of materials. In some applications, the system can be used to apply strapping to products supported on a shipping pallet, and/or to secure coils of material in the coiled configuration. The system can further include a conveyor or other transport device for advancing products or the like into position for strapping.

The exemplary system in accordance with the present disclosure, therefore, permits application and installation of strapping to many more product types and configurations than prior art fixed-type (e.g., horizontal or vertical) strapping machines.

The exemplary robotic strapping machine of the present disclosure has been designed to have the capability of automatically strapping products together at a variety of load types, orientations, configurations and sizes. The machine is adaptable to use with a wide variety of products and in a wide variety of orientations and departs from standalone machines that can only perform a limited number of functions in a limited or single orientation.

The system of the present disclosure utilizes robotic arms to make almost unlimited motions to position a pair of strapping end effectors for strapping through voids and/or around perimeters of objects, such as coils of material, for example. The end effectors are specifically designed to perform these functions by having integrated motion of its strapping chutes for different widths and lengths of products/objects. The tooling side end effector is configured to control the feeding of the strap through the chutes, tension the strap, weld and cut the strap. The integrated design allows for the tensioner module and sealer module to be integrated to the tooling head end effector so that the robot can make the motions needed to complete its tasks. The tooling in the tooling head has been specifically designed to allow for all the automated motions to complete strapping as needed.

It should be appreciated that the present exemplary system can be used to strap a wide variety of materials besides rolled material, which can provide added value to the system particularly in settings where both rolled and non-rolled materials are to be strapped.

It should be appreciated that aspects of the present disclosure include:

- The placement of the tensioner and sealer module (e.g., strapping head), as well as all the chute components and all of the connecting tooling on the end effector of a robot such that all components are movable.
- The integrated servo motion of the strap chutes on the end effector
- The joining of strap chutes using two robots and their end effectors through the use of joining tooling.
- Verification of joining through sensors and logic
- The ability to find chute location through sensors and logic The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A strapping system for automatically applying strapping to at least one associated object, the strapping system comprising:

a first end effector and a second end effector, each of the end effectors mountable to a robotic arm having multiple axes of rotation for movement in X-Y-Z dimensions, and each of the end effectors including at least a portion of a chute, the end effectors movable relative to each other when mounted to said robotic arm such that the chute portions of each end effector can be selectively brought together in a plurality of orientations to define a generally continuous chute loop through which a strapping material can be advanced to surround the at least one associated object located at least partially within the chute loop, wherein at least one of the chute portions is adjustable in length and lateral spacing to change a dimension of the chute.

2. The strapping system of claim 1, wherein at least one of the end effectors further includes a strapping head configured for retaining, severing and joining together adjacent portions of a strapping material after it is advanced through the chute.

3. The strapping system of claim 1, wherein at least one of the end effectors further includes a strap feeding/tensioning device, the strap feeding/tensioning device configured to advance strapping material through the chute, and to apply tension to the strapping material after advancing the strapping material through the chute so as to draw the strapping material against the at least one associated object prior to the strapping head severing and joining together the strapping material.

4. The strapping machine of claim 1, wherein the chute portions are c-shape, whereby when the chute portions are brought together the chute is a rectangular chute.

5. The strapping machine of claim 4, wherein the c-shape chute portions are comprised of a vertical chute portion, a stationary chute portion fixed to the vertical chute portion and extending at a right angle thereto, and a movable chute portion movably connected to the vertical chute portion and extending at a right angle thereto, wherein said c-shaped chute portions form a continuous chute which is adjustable to accommodate strapping multiple coils together.

6. The strapping machine of claim 1, further comprising a sensor mounted to at least one of the chute portions for detecting a void in a coil of material.

7. The strapping machine of claim 1, further comprising a sensor for detecting when the chute portions are abuttingly engaged.

8. The strapping machine of claim 1, wherein the chute portions include pivotable chute brackets adapted to move between a closed position for retaining a strapping material during feeding of the strapping material through the chute, and an open position for releasing the strapping material when tension is applied to the strapping material.

9. The strapping machine of claim 1, wherein the chute portions of each end effector include locating features including a protrusion/recess of one of said chute portions for mating with a corresponding recess/protrusion on the other of said chute portions such that the locating features align the chute portions when the chute portions are brought together.

10. A strapping system for automatically applying strapping to at least one associated object having a void, the strapping system comprising:

means for forming a continuous chute passing through the void of the at least one associated object, the means for forming a continuous chute including a first end effector and a second end effector, each of the end effectors mountable to a robotic arm which can rotate in multiple axial directions for movement in X-Y-Z dimensions, and each of the end effectors including at least a portion of a chute, the end effectors movable relative to each other when mounted to said robotic arm such that the chute portions of each end effector can be selectively brought together in a plurality of orientations to define a generally continuous chute loop through which a strapping material can be advanced to surround the at least one associated object located at least partially within the chute loop, wherein at least one of the chute portions is adjustable in length and lateral spacing to change a dimension of the chute;

means for advancing a strapping material through the continuous chute; and means for securing a tag end of the strapping material to a standing portion of the strapping material.

* * * * *